US008172662B2

(12) United States Patent
Fujimoto

(10) Patent No.: US 8,172,662 B2
(45) Date of Patent: May 8, 2012

(54) GAMING MACHINE

(75) Inventor: Jun Fujimoto, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 920 days.

(21) Appl. No.: 11/866,109

(22) Filed: Oct. 2, 2007

(65) Prior Publication Data

US 2008/0113713 A1 May 15, 2008

(30) Foreign Application Priority Data

Oct. 6, 2006 (JP) ..... 2006-274706

(51) Int. Cl.
*A63F 9/24* (2006.01)

(52) U.S. Cl. ..... 463/17

(58) Field of Classification Search ..... 463/17
See application file for complete search history.

(56) References Cited

U.S. PATENT DOCUMENTS 1,087,252 A * 2/1914 Muzzy ..... 346/33 R
2,099,173 A * 11/1937 Norris ..... 273/143 R
4,732,385 A * 3/1988 Castellanos ..... 273/142 B
5,257,179 A * 10/1993 DeMar ..... 463/25
6,804,763 B1 * 10/2004 Stockdale et al. ..... 711/170
7,815,507 B2 * 10/2010 Parrott et al. ..... 463/36
2005/0239536 A1 10/2005 Ogiwara

OTHER PUBLICATIONS

Wikipedia, USB Flash Drives, http://en.wikipedia.org/wiki/USB_flash_drive.*

* cited by examiner

*Primary Examiner* — Corbett B Coburn
(74) *Attorney, Agent, or Firm* — Oblon, Spivak, McClelland, Maier & Neustadt, L.L.P.

(57) ABSTRACT

A gaming machine includes a roulette board where a game is performed continually, a plurality of player terminals that enables bet to be placed on the game performed in the roulette board, a control section that controls a predetermined amount of game value to be added to a winning player terminal based on a result of the game performed in the roulette board, and a game history storage section that stores a history of the game performed continually in the roulette board, while enabling the history of the game to be retrieved.

7 Claims, 6 Drawing Sheets

GAMING MACHINE

The present disclosure relates to subject matter contained in Japan Patent Application No. 2006-274706 filed on Oct. 6, 2006, which is expressly incorporated herein by reference in its entireties.

BACKGROUND OF THE INVENTION

The present invention relates to a gaming machine such as a roulette gaming machine and the like which is provided with a game section where a game is executed and player terminals for enabling players to perform BET operation for the game executed in the game section, and which enables the game value to be paid to the player terminal based on a result of the game executed in the game section.

As described above, as a gaming machine for enabling the BET operation for the game executed in the game section, for example, known is a roulette gaming machine as disclosed in U.S. publication No. 2005/0239536 A1. Generally, the game section of the roulette gaming machine is configured to shoot a ball to within a roulette board that is controlled to rotate and that has a plurality of pockets with various kinds of numbers drawn therein along the circumference, and players predict a number, color, region and the like of a pocket of the roulette board which the ball finally enters, and perform the BET operation in a plurality of player terminals (also referred to as satellites) installed around the game section. Then, a control section that controls the game operation performs control to give a predetermined amount of game value to a player terminal on the condition that the player wins by the shot ball being placed in the bet pocket.

In the aforementioned gaming machine, it is important that fairness is maintained in the game performed in the game section. In other words, the roulette gaming machine exemplified above needs to be designed so that the ball enters each of all the pockets with the equal probability.

However, it is considered that the above-mentioned equal probability changes due to production errors of structural members, particularly a roulette board, support portion that rotatably supports the roulette board and the like in manufacturing the roulette gaming machine, variations with time, conditions of an installation place, changes in the condition, and the like, and it is likely that a pocket that the ball enters can be predicted to some extent during the game. Meanwhile, in the gaming machine that controls the game operation in the game section according to a program stored in ROM and the like, it is considered that the program is maliciously changed, and from the viewpoint of keeping fairness of the game, there is room for improvement.

Accordingly, a gaming machine is required that enables fairness of the game to be maintained.

BRIEF SUMMARY OF THE INVENTION

To achieve the above-mentioned object, a game machine according to the present invention comprises a game section where a game is performed continually; a plurality of player terminals that enables BET operation for the game performed in the game section; a control section that controls a predetermined amount of game value to be added to a winning player terminal based on a result of the game performed in the game section; and a game history storage section that stores a history of the game performed continually in the game section, while enabling the history of the game to be retrieved.

In the above-mentioned configuration, a main body of the gaming machine is provided with the interface section (connection terminal) to output the game history information stored in the game history storage section, the administrator connects to the interface section either one of various kinds of information storage media such as a card-shaped memory, stick-shaped memory and the like having portability, and the game history can thereby be retrieved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment where a roulette gaming machine embodies a gaming machine according to the invention will be described below with reference to accompanying drawings. In addition, the roulette gaming machine is a gaming machine where players predict numbers and the like determined by the roulette board, bet game media such as medals and the like that the players have on the predicted numbers and the like, and when winning the numbers and the like that the players predict, are able to receive payout with a predetermined number of game media.

Figure 1:
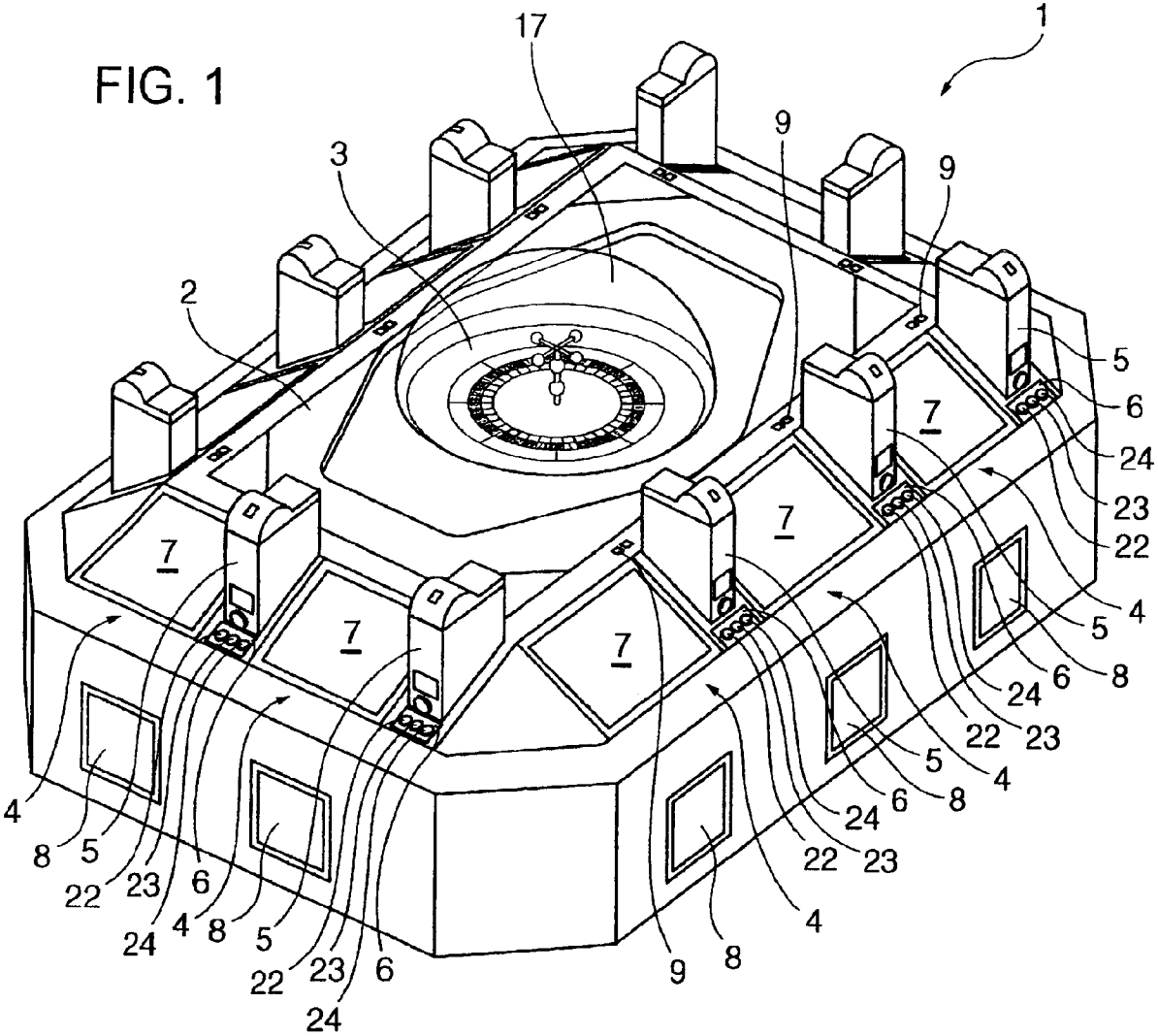
FIG. 1 is a perspective view showing an entire configuration of a roulette gaming machine showing an example of a gaming machine according to the present invention.

FIG. 1 illustrates one embodiment of the roulette gaming machine, and is a perspective view showing the entire configuration. The roulette gaming machine 1 is provided with a housing 2 that is a main body portion, a roulette board 3 that is provided in the substantially center portion on the upper plane of the housing 2 and that constitutes a game section, and at least one player terminal, preferably, a plurality of (ten in this embodiment) player terminals 4 installed around the roulette board 3 to surround the roulette board 3.

Each of the player terminals 4 is only required to have a configuration for enabling a player to perform BET operation, and has at least a game media receiving device 5 to insert a game medium such as a coin, medal used in the game, and the like, a control section 6 comprised of a plurality of control buttons and the like to which predetermined instructions are input by a player, and an image display device 7 that mainly displays images on the BET table in performing the game. Then, the player operates the control section 6 and the like while looking at the images displayed in the image display device 7, and is thereby capable of participating in the game continually carried out in the roulette board 3.

Further, on side planes of the housing 2 where the player terminals 4 are installed, payout openings 8 are provided to pay out game media that players have. Further, a speaker 9 to output music, sound effects and the like is provided at the upper right of the image display device 7 of each of the player terminals 4.

Figure 2:
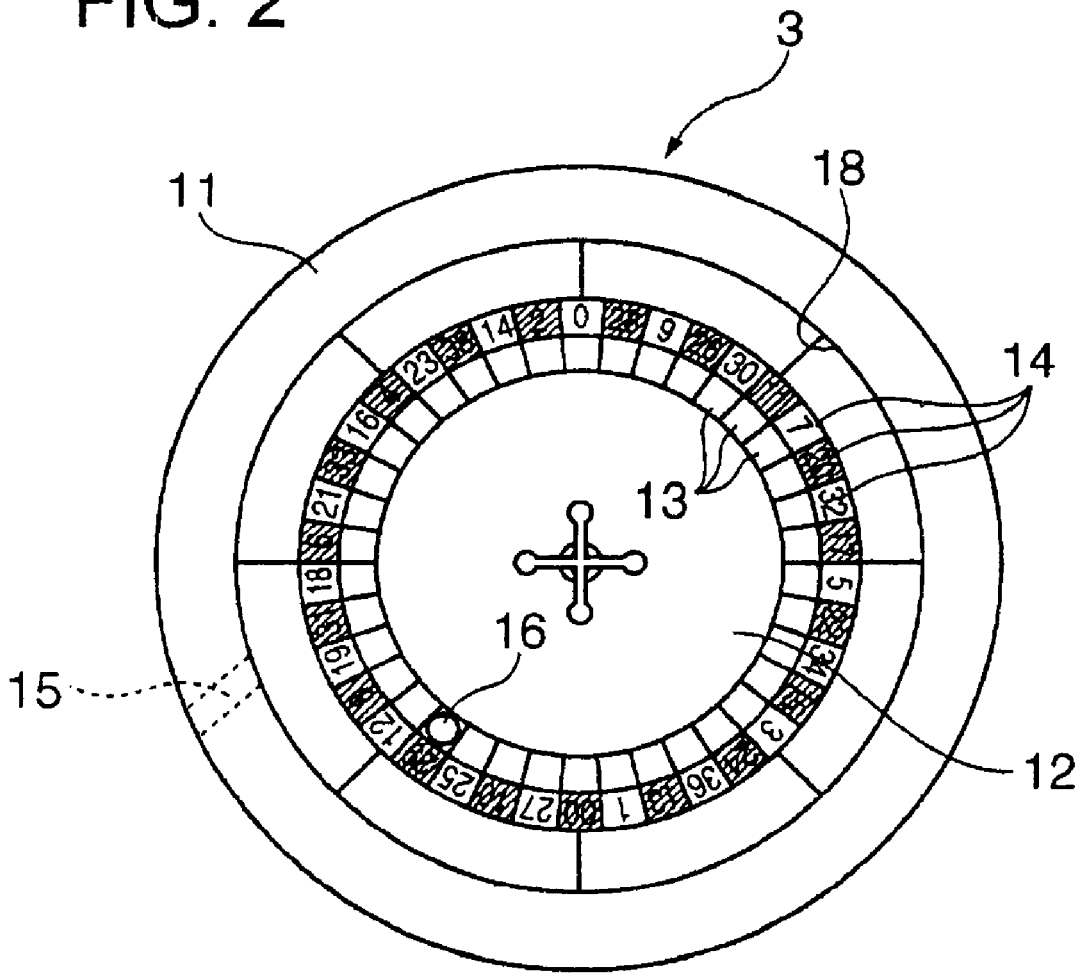
FIG. 2 is a plan view showing a configuration of a roulette board.

FIG. 2 is a plan view showing a configuration of the above-mentioned roulette board 3. The roulette board 3 is provided with a frame member 11 fixed to the housing 2, and a rotating disk 12 stored and supported rotatably inside the frame member 11. Then, a number of (38 in this embodiment) concave ball storage grooves 13 are formed on the upper plane of the rotating disk 12. Further, on the upper plane of the rotating disk 12 in the outer side of the ball storage grooves 13, number indication plates 14 are formed which indicate respective numbers of "0", "00", and "1" to "36" as graphic numbers corresponding to the ball storage grooves 13.

Further, a ball insertion opening 15 is formed inside the frame member 11. The ball insertion opening 15 is coupled to a ball insertion device not shown, and with the ball insertion device driven, a ball 16 is inserted onto the rotating disk 12 from the ball insertion opening 15. Furthermore, the entire upper portion of the roulette board 3 is covered with a semi-spherical transparent acrylic cover member 17.

The frame member 11 is gently inclined toward the inside, and a guide wall 18 is formed at the midpoint. The guide wall 18 has functions of guiding the inserted ball 16 against the centrifugal force to roll the ball 16, and when the rotation speed of the ball 16 weakens and the centrifugal force decreases, the ball 16 rolls down on the slope of the frame member 11 toward the inside and reaches the rotating disk 12 being rotated. Then, the ball 16 rolling onto the rotating disk 12 further runs on the number indication plates 14 outside the rotating disk 12 being rotated, and is stored in either one of the ball storage grooves 13, and a winning number is the number described on the number indication plate 14 corresponding to the ball storage groove 13 where the ball 16 is stored.

A winning judgment device (not shown) is installed under the roulette board 3. The winning judgment device is a device for judging a number of the ball storage groove 13 where the ball 16 is stored. Further, a ball collecting device (not shown) is installed under the rotating disk 12. The ball collecting device is a device for collecting the ball 16 on the rotating disk 12 after finishing the game. In addition, the ball insertion device, winning judgment device and ball collecting device are already well-known, and descriptions thereof are omitted.

Described next are configurations of the control section 6 and image display device 7.

As shown in FIG. 1, the control section 6 is provided to the side portion of the image display device 7 of the player terminal 4, and has buttons arranged to be operated by a player. More specifically, from the left as viewed from the position opposite to the player terminal 4, arranged are a BET confirmation button 22, CASHOUT button 23, and HELP button 24.

The BET confirmation button 22 is a button to be pressed by a player in confirming the BET after performing the BET operation using the image display device 7. Then, when the player bets on a number described on the number indication plate 14 corresponding to the ball storage groove 13 where the ball 16 is stored in the roulette board 3, the player wins the game. When the player wins the game, credits corresponding to the number of bet chips are added to the credits that the player has at this time based on the award table.

The CASHOUT button 23 is a button to be pressed ordinarily at the time the game is finished. When the CASHOUT button 23 is pressed, game media are cashed out from the payout opening 8 in accordance with the credits which the player acquires by the game and the like and has at this time.

The HELP button 24 is a button to be pressed in the case where the operation method of the game is uncertain or the like. When the HELP button 24 is pressed, a help screen showing various kinds of operation information is displayed in the image display device 7 immediately after pressing the button 24.

Figure 3:
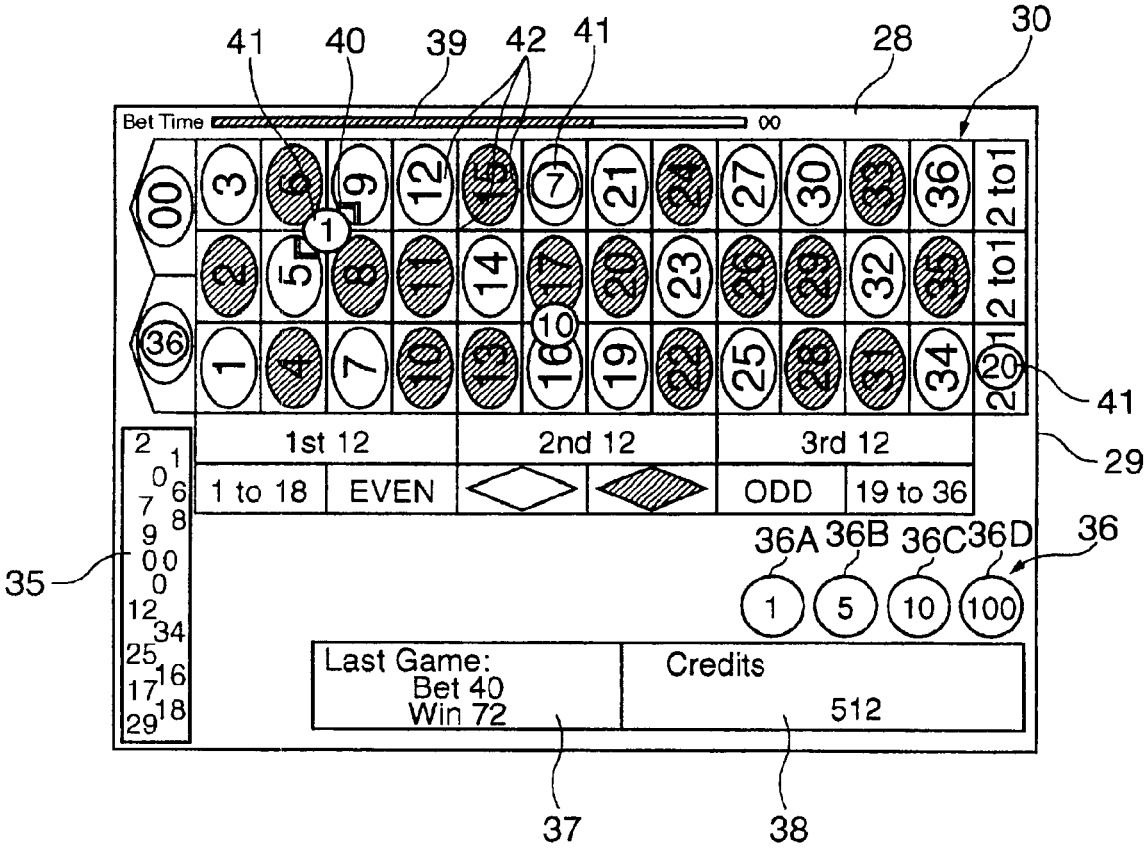
FIG. 3 is a view showing an example of a BET screen.

As shown in FIG. 3, the image display device 7 is the so-called touch panel type liquid crystal display device with a touch panel 28 attached to its front face, and by pressing an icon displayed on a liquid crystal screen 29 by a finger or the like, the player is able to select the icon. FIG. 3 shows an example of a display screen displayed in the image display device 7 during the game. As shown in this figure, the image display device 7 displays a table type betting board (BET screen) 30 to predict a winning number and the like at this point of the game. The BET operation is capable of being performed using owned credits while looking at the BET screen 30 displayed in the image display device 7.

Herein, the BET screen 30 is described specifically.

The BET screen 30 displays the same numbers of "0", "00" and "1" to "36" as those shown in the number indication plates 14 arranged in the shape of a matrix. Further, specific BET areas are also arranged in the shape of a matrix to bet chips while designating "odd numbers", "even numbers", "kind of color (red or black) of the number indication plate 14" and/or "specific range of numbers (for example, "1" to "12" and the like).

Then, in the lower portion of the BET screen 30 are displayed a result history display portion 35, unit BET button 36, CASHOUT result display portion 37, and number-of-credit display portion 38, in this order from the left on the screen.

The result history display portion 35 displays a list of results of winning numbers of games up to the last time (a single game means a series of operation where a player bets in the player terminal 4, the ball 16 drops into the ball storage groove 13, and based on the winning number, the credit is paid out). At this point, when a single game is finished, a new winning number is added to the top and displayed, and it is possible to check the history of winning numbers of maximum sixteen games.

Further, the unit BET button 36 is a button to bet a chip on a BET area 42 (on a square of a number or mark, or on a line forming squares) that the player designates. The unit BET button 36 is comprised of four kinds of buttons, 1 BET button 36A, 5 BET button 36B, 10 BET button 36C and 100 BET button 36D.

First, a player directly presses the screen on the BET area 42 to bet by the finger or the like, and thereby designates by a cursor 40. When the player presses the 1 BET button 36A at this state, the player is capable of betting a chip on a chip basis (the number of bet chips increases in the order of "1"→"2"→"3"→ . . . whenever the player presses the 1 BET button 36A by the finger or the like). Similarly, when the player presses the 5 BET button 36B, the player is capable of betting chips on a five-chip basis (the number of bet chips increases in the order of "5"→"10"→"15"→ . . . whenever the player presses the 5 BET button 36B by the finger or the like), and when the player presses the 10 BET button 36B, the player is capable of betting chips on a ten-chip basis (the number of bet chips increases in the order of "10"→"20"→"30"→ . . . whenever the player presses the 10 BET button 36C by the finger or the like). Further, when the player presses the 100 BET button 36D, the player is capable of betting chips on a hundred-chip basis (the number of bet chips increases in the order of "100"→"200"→"300"→ . . . whenever the player presses the 100 BET button 36D by the finger or the like). In the BET area 42, the number of chips bet up to this time is displayed as a chip mark 41, and the number displayed on the chip mark 41 indicates the number of bet chips.

Further, the CASHOUT result display portion 37 displays the number of bet chips of the player in the last game, and the number of credits to cash out. The number obtained by subtracting the number of bet chips from the number of credits to cash out is the number of credits that the player newly acquires by the last game.

Furthermore, the number-of-credit display portion 38 displays the number of credits that the current player has. The number of credits decreases corresponding to the number of bet chips (one credit per chip) when the chips are bet. Meanwhile, when the player wins the bet chips and the credits are cashed out, the number of credits increases corresponding to the number of chips to cash out. In addition, when the number of credits the player has becomes "0", the game is finished.

Then, a BET timer graph 39 is provided in the upper portion of the BET screen 30. The BET timer graph 39 is a graph to display the remaining time during which the player is allowed to bet, the red graph starts extending to the right gradually at the time the game is started, and when the red graph reaches the rightmost side, the BET permission time finishes in the current game. When the BET time of the player finishes in each of the player terminals 4, the ball 16 is dropped onto the roulette board 3.

Figure 4:
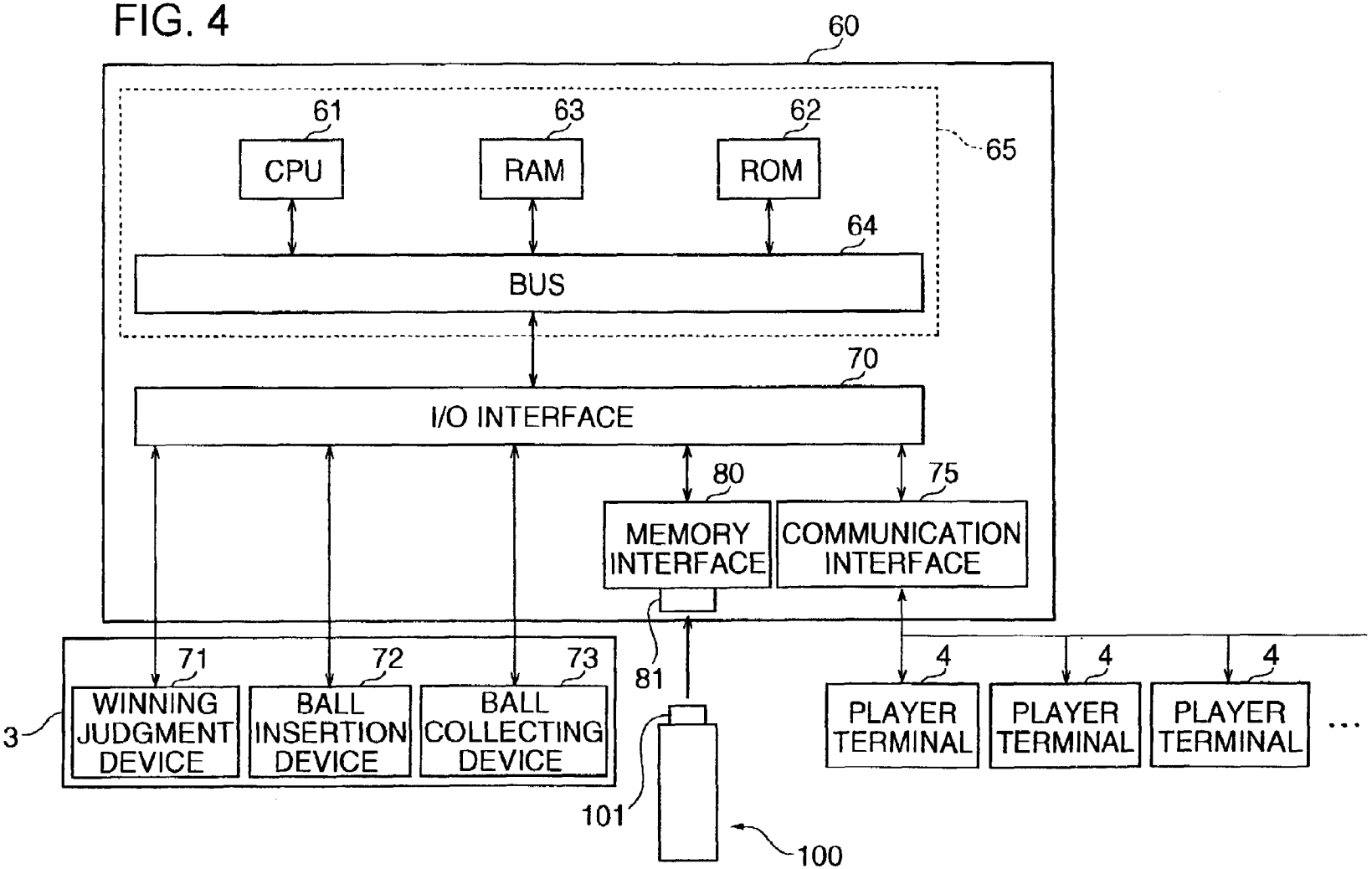
FIG. 4 is a block diagram schematically showing a control system of the roulette gaming machine.

Referring to FIG. 4, described next is a configuration according to a control system of the roulette gaming machine 1. FIG. 4 is a block diagram schematically showing the control system of the roulette gaming machine.

A main control section (a first controller) 60 of the roulette gaming machine 1 has a microcomputer 65 comprised of, as a core, a CPU 61 for main control, ROM 62, RAM 63 and bus 64 for data transfer with the CPU 61, ROM 62 and RAM 63.

The CPU 61 is connected to various devices for driving the roulette board 3, more specifically, the winning judgment device 71, ball insertion device 72, ball collecting device 73 and the like via an I/O interface 70. Further, the I/O interface 70 is connected to a communication interface 75, and via the communication interface 75, the main control section 60 transmits and receives data such as BET information, award information and the like to/from each of the player terminals 4.

Further, the I/O interface 70 is connected to a memory interface (a first interface) 80, and via a connection terminal 81 of the interface 80, it is possible to transmit game history information described later to an external memory (an information storage medium) 100. In addition, for transmission and reception of the game history information in this embodiment, the memory 100 is configured as a storage medium enabling the data to be carried (more specifically, a stick-shaped storage medium provided with a serial communication connector (for example, RS232C connector) 101), the memory interface 80 is connected to a serial port 81 to/from which such a serial communication connector 101 is attached and removed, and by connecting the memory 100 having portability to the serial port 81, it is possible to retrieve the game history information.

The ROM 62 in the main control section 60 is comprised of, for example, a semiconductor memory or the like, and stores programs to implement basic functions of the roulette gaming machine 1, more specifically, a program to control each device in the roulette board 3, a program to control each of the player terminals 4 in a leading manner and the like, while storing the award table in the roulette game and the like.

The RAM 63 is a memory for temporarily storing various kinds of data computed by the CPU 61, and for example, temporarily stores the BET information of chips supplied from each player terminal 4, the winning number of the roulette board 3 judged by the winning judgment device 71, data on a result of processing executed by the CPU 61 and the like.

Further, the RAM 63 stores at least the game history information carried out continually in the roulette board 3, and the game history information is transmitted to the external memory 100. In this case, the game history information to be stored naturally includes winning information for each game (information of the number of the ball storage groove 13 where the ball is stored for each game), and further, may include time information associated with the winning information. Furthermore, as well as the game history information carried out in the roulette board 3, game history information (BET information, winning information, payout rate information and the like) in each player terminal 4 may be included.

Then, based on the data and programs stored in the ROM 62 and RAM 63, the CPU 61 controls the winning judgment device 71, ball insertion device 72 and ball collecting device 73 provided in the roulette board 3, and executes control processing accompanying the proceeding of the game such as dropping of the ball 13 onto the roulette board 3, collection of the ball from the roulette board 3, judgment processing of the winning number of the ball storage groove 13 into which the ball 16 drops, and the like.

Further, as well as the control processing accompanying the proceeding of the game, the CPU 61 has functions of transmitting and receiving data to/from each player terminal 4, and controlling each player terminal 4 in a leading manner to cause the game to proceed. More specifically, the CPU 61 receives the BET information transmitted from each player terminal 4, performs winning judgment processing of bet chips based on the winning number that is a result of the game and the BET information transmitted from each player terminal 4, and calculates the number of credits paid out in each player terminal 4 by referring to the award table.

Described next is a configuration according to a control system of the player terminal 4 connected to the CPU 61 of the above-mentioned main control section 60.

Figure 5:
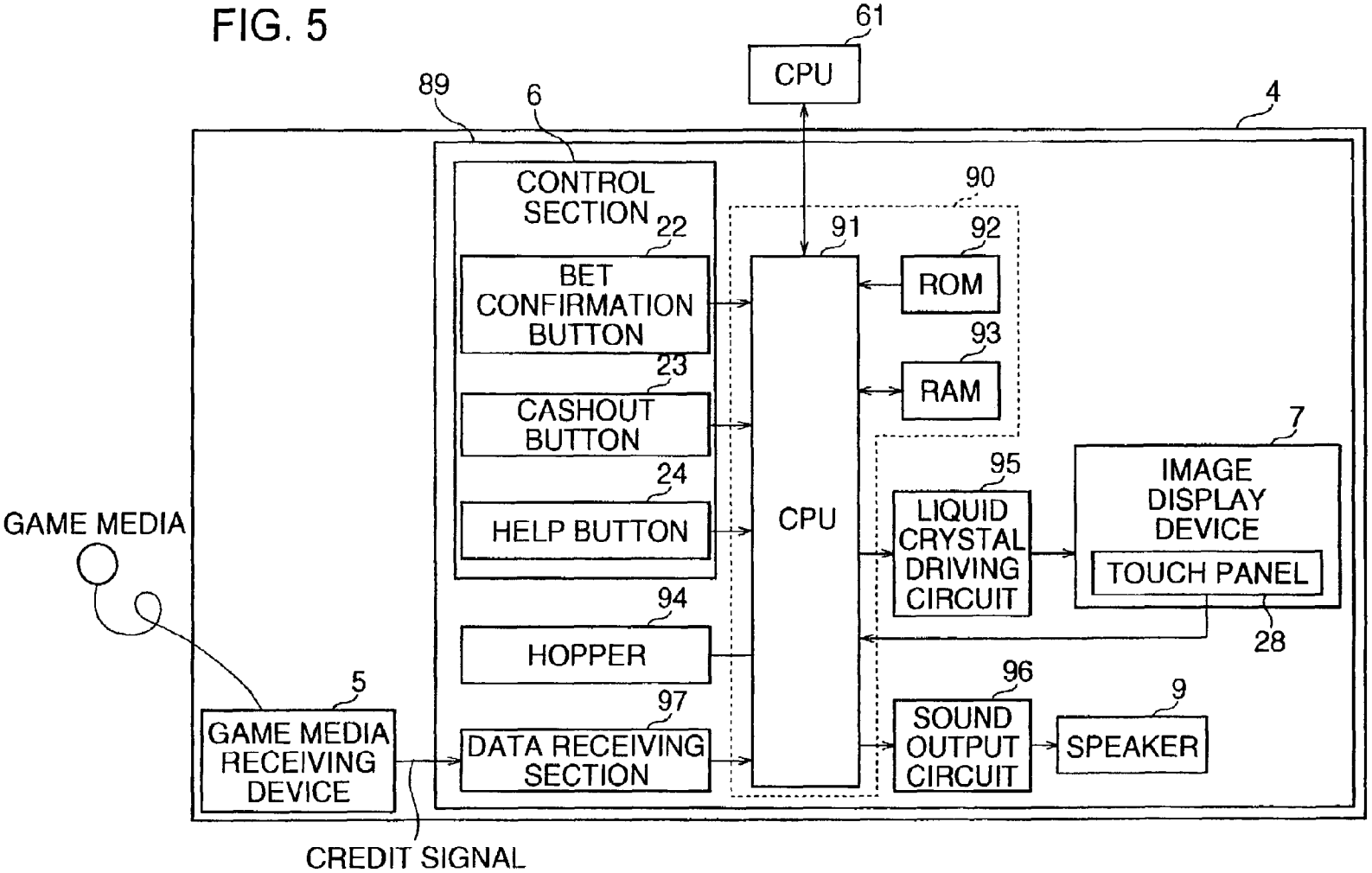
FIG. 5 is a block diagram schematically showing a control system of a player terminal.

FIG. 5 is a block diagram schematically showing the control system of the player terminal 4 according to this embodiment.

Each of the player terminals 4 is provided with a main body portion 89 where the image display device 7 and the like are provided, and a game media receiving device 5 attached to the main body portion 89. Further, the main body portion 89 is provided with a player terminal control section 90, and some peripheral device equipment.

The player terminal control section 90 is provided with a processor 91 for player terminal control, ROM 92, and RAM 93.

The ROM 92 is comprised of, for example, a semiconductor memory or the like, and stores a program to implement basic functions of the player terminal 4, various kinds of other programs required to control the player terminal 4, data table, and the like.

The RAM 93 is a memory for temporarily storing a variety of data computed by the processor 91, the number of credits that the player currently has, the status of BET of chips by the player, and the like.

Further, the processor 91 is connected to the BET confirmation button 22, CASHOUT button 23, and HELP button 24 provided in the control section 6 (see FIG. 1). Then, based on an operation signal output by pressing each button or the like, the processor 91 performs control to execute each kind of operation corresponding to the signal. More specifically, based on an input signal supplied from the control section 6 in response to an input of the operation of the player and the data and program stored in the ROM 92 and RAM 93, the processor 91 executes various processing, and transmits the result to the CPU 61 of the main control section 60.

Furthermore, the processor 91 receives a command signal from the CPU 61 of the main control section 60, controls peripheral devices constituting the player terminal 4, and causes the roulette game to proceed in the player terminal 4. Still furthermore, according to the content of the processing, based on an input signal supplied from the control section 6 in response to an input of the operation of the player and the data and program stored in the ROM 92 and RAM 93, the 91 processor executes various processing, controls the peripheral devices constituting the player terminal 4 based on the result, and causes the roulette game to proceed in the player terminal 4. In addition, which method is used to perform the processing is set for each processing corresponding to the content of the processing. For example, the payout processing of game media for the winning number corresponds to the former method, while the BET operation processing by the player corresponds to the latter method.

Moreover, the processor 91 is connected to a hopper 94, and the hopper 94 pays out a predetermined number of game media from the payout opening 8 by a command signal from the processor 91.

Further, the processor 91 is connected to the image display device 7 via a liquid crystal driving circuit 95. The liquid crystal driving circuit 95 is comprised of a program ROM, image ROM, image control CPU, work RAM, VDP (Video Display Processor), video RAM and the like. The program ROM stores an image control program for display in the image display device 7 and various selection tables, and the image ROM stores, for example, dot data to form images displayed in the image display device 7. Further, based on parameters set by the processor 91, the image control CPU determines an image to be displayed in the image display device 7 from among the dot data beforehand stored in the image ROM, according to the image control program beforehand stored in the program ROM. Meanwhile, the work RAM is configured as temporarily storing portion when the image control CPU executes the image control program. The VDP forms an image corresponding to the content of display determined by the image control CPU, and outputs the image to the image display device 7. In addition, the video RAM is configured as temporarily storing means when the VDP forms the image.

The touch panel 28 is attached to the front of the image display device 7 as described above, and the operation information of the touch panel 28 is transmitted to the processor 91. The touch panel 28 detects the BET operation of chips of the player in the BET screen 30. More specifically, the player touches the touch panel 28 to operate for selection of the BET area 42, operation of the unit BET button 36 and the like, and the information is transmitted to the processor 91. Then, based on the information, the RAM 93 stores the BET information (the BET area 42 designated in the BET screen 30, and the number of bet chips) of the current player whenever necessary. Further, the BET information is transmitted to the CPU 61 of the main control section 60, and is stored in the BET information storage area of the RAM 63.

Further, a sound output circuit 96 and speaker 9 are connected to the processor 91, and the speaker 9 generates various kinds of sound effects when respective kinds of representation are performed based on the output signal from the sound output circuit 96. Furthermore, the processor 91 is connected to the game media receiving device 5 that is a device into which a game medium such as a coin, medal or the like is inserted via a data receiving section 97. The data receiving section 97 receives a credit signal transmitted from the game media receiving device 5, and based on the transmitted credit signal, the processor 91 increases the number of credits stored in the RAM 93.

Described next is a configuration according to a control system of the memory 100.

Figure 6:
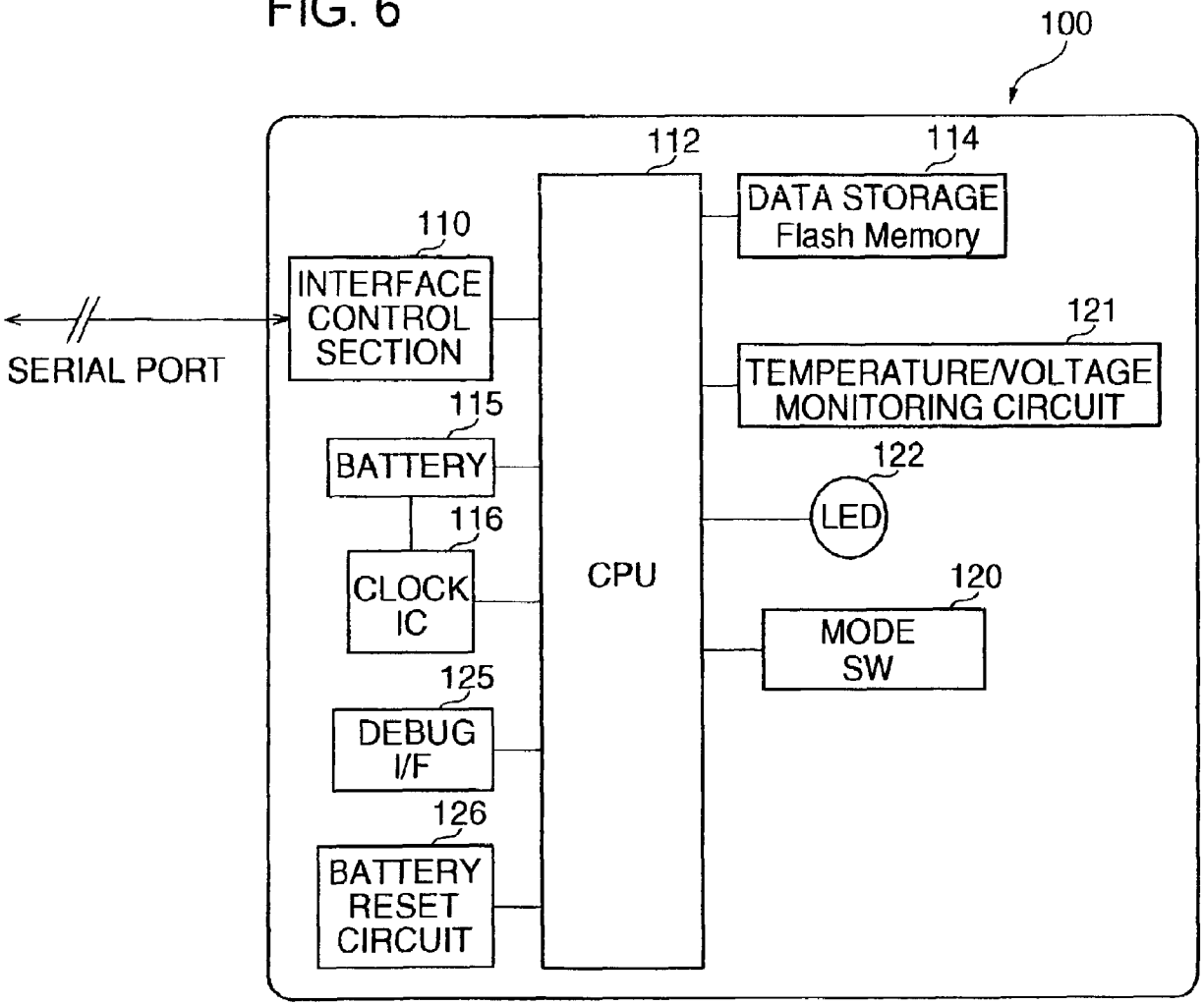
FIG. 6 is a block diagram schematically showing a control system of a memory.

FIG. 6 is a block diagram schematically showing the control system of the memory 100 according to this embodiment.

As described above, the memory 100 is configured as a stick-shaped storage medium, and provided with an interface control section (including a third controller and a second interface) 110 for controlling serial communication between the serial communication connector 101 and the serial port 81 provided in the memory interface 80, and a [[CPU]] processor 112 (a second controller; the processor may comprise the second interface for enabling serial communication between the serial communication connector and the serial port provided in the first interface, and a third controller for controlling said serial communication) that stores an operation program. The processor 112 is connected to a data storage memory (flash memory) 114, and the memory 114 stores the game history data which is stored in the RAM 63 of the main control section 60 and is transmitted via the serial communication connector 101. In addition, the processor 112 is connected to a clock IC 116 driven by a battery 115, and adds the time information to the game history data transmitted via the serial communication connector 101 to store in the data storage memory 114.

In addition, as well as the aforementioned elements, the memory 100 may include an operation setting switch (mode SW) 120, temperature/voltage monitoring circuit 121 for monitoring the temperature state and voltage state, and LED 122 for operation state display for displaying the operation state, and further, may include a debug I/F 125 for checking the operation state of the processor 112, battery reset circuit 126 and the like.

The memory 100 in this embodiment is beforehand mounted to the serial port 81 provided in the memory interface 80 of the main control section 60, and the CPU 61 of the main control section 60 executes control software for controlling the memory 100, and thereby recognizes the memory 100. Then, the proceeding status (the game history information stored in the RAM 63) of the game operation of the roulette machine 1 is stored in the data storage memory 114 of the memory 100 on a predetermined-time basis.

According to the roulette gaming machine 1 configured as described above, the history information of the game sequentially carried out in the roulette board 3 is stored in the RAM 63 having the function as the game history storage section, and as described above, the game history information can be retrieved in the external memory 100 via the interface 80. Therefore, an administrator such as a worker of the gaming arcade and the like verifies the retrieved game history information, is thus capable of checking, for example, whether specific winning is biased, whether predetermined regularity arises in winning, and the like, and thereby able to find a cause of inhibition on the fairness of the game at an early stage, and to perform appropriate support processing.

For example, in the above-mentioned roulette gaming machine, since thirty-eight concave ball storage grooves 13 are provided, on the assumption that winning is established in all the grooves at the equal rate, the winning probability of one of the ball storage grooves 13 is about 2.63%. Therefore, by verifying the winning probability for each of the ball storage grooves 13, and/or verifying a deviation from the theoretical value, it is possible to check whether the fairness is inhibited or not.

As a result, even under circumstances where the winning probability changes due to production errors of each structural member in manufacturing the roulette gaming machine 1, variations with time, conditions of an installation place, changes in the condition, and the like, and it is likely that a ball storage groove 13 that the ball enters can be predicted to some extent, it is possible to cope with such circumstances at an early stage, and to maintain the fairness of the game.

Further, in the above-mentioned configuration, as well as the game history information of the roulette board 3, the RAM 63 of the main control section 60 may store the game history information (BET information, payout information and the like) in each of the player terminals 4 to enable the game history information of the player terminals to be retrieved together.

By configuring in this manner, it is possible to verify the BET operation performed by the player in each of the player terminals 4 and the payout information in association with the game history information, and it is thereby possible to check whether or not the fairness of the game is maintained with higher reliably.

Further, in the above-mentioned configuration, since the time information is added to the game history information, it is possible to check the operating status (occupation status of the player terminals 4) on a time basis, winning status on a time basis, payout status, and the like, and it is thereby possible to check whether or not the fairness of the game is maintained with higher reliably.

In addition, the roulette gaming machine of this embodiment is configured in that the game of the roulette board that is the game section is performed by rolling the ball actually on the rotating roulette board, but the above-mentioned configuration is applicable to roulette gaming machines for controlling winning by drawing processing and the like, i.e. gaming machines for virtually displaying the game section by the image display device. In such a configuration, since the winning is determined by drawing processing according to a program stored in ROM, it is considered that the program is maliciously changed, but by retrieving the game history information to verify as described above, it is possible to immediately find falsification of the tempered program, and to maintain the fairness of the game.

Further, in the above-mentioned configuration, the interface section is provided inside the roulette gaming machine 1 to output the game history information stored in the RAM, and the administrator connects an information storage medium with portability to the interface section and thereby retrieves the game history. However, the method of retrieving the game history is capable of being modified as appropriate. For example, a communication management section may be provided in the main control section 60 to transmit the history information to a memory of a host computer or the like in the gaming arcade via communication means such as LAN and the like when necessary or on a predetermined time basis.

The gaming machine according to the invention is not limited to the roulette gaming machine of this embodiment as described above, and is applicable to various kinds of gaming machines such as, for example, card machines, dice machines and the like.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. A roulette gaming system comprising:

a roulette gaming machine including an interface detachably connectable to an external memory;

a roulette board having a plurality of ball receiving portions, each portion indicating different number information;

a game section that determines a winning number based on number information of a ball receiving portion at which a roulette ball stops;

at least one player terminal that receives a command from a player to place a bet on the game performed in the game section;

a first controller that controls a predetermined amount of game value to be added to a winning player terminal based on a result of the game performed in the game section; and a storage section that stores the winning number and time information associated with the winning number as a winning history for each game performed by the game section, the winning history stored in the storage section written through the interface to the external memory, and a host computer configured to confirm whether or not a deviation from a theoretical value occurs in a specific ball receiving portion, the theoretical value being obtained by verifying a winning probability for each of the ball receiving portions during a predetermined time.

2. The roulette gaming system according to claim 1, wherein the game section has a display device that displays images of a game operation.

3. The roulette gaming system according to claim 1, wherein the external memory has an elongated rectangular shape.

4. The roulette gaming system according to claim 1, wherein the game history information stored in the storage section is stored in the external memory on a predetermined-time basis.

5. The roulette gaming system according to claim 1, wherein second time information, which is a time at which the winning history is stored in the external memory, is assigned to the winning history and stored in the storage external memory, the winning history being read out from the storage section and transmitted through the interface.

6. The roulette gaming system according to claim 1, wherein the storage section includes a processor separated from the game section.

7. The roulette gaming system according to claim 1, wherein the storage section includes an LED separated from the game section.

* * * * *